US009844716B2

(12) United States Patent
Foster

(10) Patent No.: US 9,844,716 B2
(45) **Date of Patent: *Dec. 19, 2017**

(54) PUTTER WITH ADJUSTABLE ALIGNMENT FEATURES

(71) Applicant: Callaway Golf Company, Carlsbad, CA (US)

(72) Inventor: Philip G. Foster, Vista, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/607,969

(22) Filed: May 30, 2017

(65) Prior Publication Data

US 2017/0259152 A1 Sep. 14, 2017

Related U.S. Application Data

(63) Continuation of application No. 15/210,133, filed on Jul. 14, 2016, now Pat. No. 9,662,544, which is a continuation of application No. 14/702,478, filed on May 1, 2015, now Pat. No. 9,415,279.

(60) Provisional application No. 61/988,729, filed on May 5, 2014.

(51) Int. Cl.

| | |
|---|---|
| ***A63B 69/36*** | (2006.01) |
| ***A63B 53/00*** | (2015.01) |
| ***A63B 53/04*** | (2015.01) |
| ***A63B 53/06*** | (2015.01) |
| ***A63B 71/06*** | (2006.01) |

(52) U.S. Cl.

CPC ..... *A63B 69/3685* (2013.01); *A63B 53/0487* (2013.01); *A63B 53/065* (2013.01); *A63B 53/007* (2013.01); *A63B 2053/0433* (2013.01); *A63B 2053/0441* (2013.01); *A63B 2053/0491* (2013.01); *A63B 2071/0694* (2013.01)

(58) Field of Classification Search

CPC ..... A63B 69/3685; A63B 53/065; A63B 53/0487; A63B 53/007; A63B 2053/0433; A63B 2053/0441; A63B 2053/0491; A63B 2071/0694

USPC ..... 473/324–350, 287–292, 219–256

See application file for complete search history.

(56) References Cited

U.S. PATENT DOCUMENTS

| | | | | |
|---|---|---|---|---|
| 9,415,279 | B2 * | 8/2016 | Foster | A63B 53/007 |
| 9,662,544 | B2 * | 5/2017 | Foster | A63B 53/065 |

* cited by examiner

*Primary Examiner* — Sebastiano Passaniti

(74) *Attorney, Agent, or Firm* — Rebecca Hanovice; Michael Catania; Sonia Lari

(57) ABSTRACT

An adjustable golf club putter head is disclosed herein. The putter head includes a removable alignment feature that can be swapped with a different alignment feature to change the alignment pattern, and a removable divider piece that contrasts with the alignment feature and can be swapped with different divider pieces to affect the cosmetics of the putter head and also adjust the putter head's mass properties.

18 Claims, 3 Drawing Sheets

PUTTER WITH ADJUSTABLE ALIGNMENT FEATURES

CROSS REFERENCES TO RELATED APPLICATIONS

The present application is a continuation of U.S. patent application Ser. No. 15/210,133, filed on Jul. 14, 2016, and issued on May 30, 2017, as U.S. Pat. No. 9,662,544, which is a continuation of U.S. patent application Ser. No. 14/702,478, filed on May 1, 2015, and issued on Aug. 16, 2016, as U.S. Pat. No. 9,415,279, which claims priority to U.S. Provisional Patent Application No. 61/988,729, filed on May 5, 2014, the disclosure of which is incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a putter type golf club head comprising alignment markings. The present invention more specifically relates to a putter-type golf club head having adjustable alignment markings on its top surface to help a golfer line up the golf club head with a golf ball.

Description of the Related Art

The golf industry routinely develops putters that are intended make the game of golf easier for the high handicap player. One such putter is disclosed in U.S. Pat. No. 4,688,798 to David Pelz, which discloses a putter with an alignment means to assist a golfer in aiming a golf ball toward a hole during putting. The Pelz patent discloses using two or three golf ball shaped indicators as the alignment means. The golf ball shaped indicators may be circles, hemispheres, or complete spheres. The Pelz patent discloses positioning the indicators along a line extending rearward from the center of percussion.

Another patent that discloses an alignment means is U.S. Pat. No. 4,659,083 to Szczepanski. The Szczepanski patent discloses a group of lines that converge toward the center of the face of the putter. The large number of converging lines taught by Szczepanski can be distracting to a golfer, however.

A further patent that discloses an alignment means is U.S. Pat. No. 7,371,184 to Tao. The Tao patent also discloses a group of lines that converge at the center of the face of a putter.

Although these inventions have provided putters for making the game of golf more enjoyable for high handicap players, the prior art has not optimized an adjustable putter alignment feature for high handicap players.

BRIEF SUMMARY OF THE INVENTION

One aspect of the present invention is a putter head comprising a removable alignment feature. Another aspect of the present invention is a putter head comprising a metal body, a lightweight divider piece, and an adjustable alignment feature.

Another aspect of the present invention is a putter comprising a body comprising a face portion and a sole portion, a divider piece comprising an opening, and an alignment piece comprising a planar portion and a first protrusion extending perpendicular to the planar portion, wherein the planar portion comprises an alignment feature, wherein the sole portion comprises a through bore, and wherein the first protrusion extends through the opening and is received within the through bore. In some embodiments, the first protrusion may comprise a threaded bore. In another embodiment, the first protrusion may have a skeletal structure, and the threaded bore may be disposed within a hollow portion of the first protrusion and held in place by a plurality of struts.

In other embodiments, the alignment feature may comprise at least two circles, and also line bisecting each of the two circles or a pair of converging lines that extend across the two circles. In another embodiment, the sole portion may comprise a second protrusion, and the through bore may extend through the second protrusion. In a further embodiment, the putter may comprise a screw having a head and a threaded portion, the through bore may extend from an opening in a lower surface of the sole to an opening in the upper surface of the sole, the first protrusion may comprise a threaded bore, and the threaded portion may extend through the through bore and engage the threaded bore of the first protrusion to removably fix the alignment piece to the body. In other embodiments, the divider piece may conform to at least a portion of a shape of the sole. In another embodiment, the sole portion may extend rearwards from a lower edge of the face portion, and the body may have an L shape.

Another aspect of the present invention is an adjustable putter head comprising a body comprising a face portion comprising an upper surface, a striking surface, and a lower surface, a sole portion comprising an upper surface, a lower surface, a first protrusion extending from the upper surface, and a through bore extending from an opening in the lower surface to an opening in the first protrusion, a divider piece comprising an opening, an alignment piece comprising a planar portion comprising an alignment feature and a thickness and a second protrusion comprising a threaded bore, and a screw comprising a threaded portion and a head, wherein the second protrusion extends perpendicular to the planar portion, wherein the second protrusion extends through the opening in the first protrusion and is received within the through bore, and wherein the threaded portion of the screw extends through the through bore and engages the threaded bore of the first protrusion to removably fix the alignment piece to the body.

In one embodiment, the alignment feature may comprise at least two circles. In a further embodiment, the upper surface of the face may comprise a recess sized to receive a portion of one of the two circles. In yet another, further embodiment, the recess may have a depth that is equivalent to the thickness of the alignment feature. In an alternative embodiment, the alignment feature may comprise at least one line extending across the two circles, which may comprise a pair of converging lines. In still another embodiment, the divider piece may comprise a first color, wherein the alignment feature comprises a second color, wherein the first color is dark, and wherein the second color is light. In another embodiment, each of the alignment piece and the divider piece may be composed of a material selected from the group consisting of composite, plastic, and aluminum.

Another aspect of the present invention is a kit comprising a putter body comprising a front portion and a sole portion, a first divider piece comprising a first shape, a first opening, and a first material, a second divider piece comprising a second shape, a second opening, and a second material, a first alignment piece comprising a first alignment feature, a first protrusion, and a third material, a second alignment piece comprising a second alignment feature, a second protrusion, and a fourth material, and a screw comprising a threaded portion and a head, wherein the first protrusion comprises a first threaded bore and the second protrusion comprises a second threaded bore, wherein the first material is different from the second material and the third material is different from the fourth material, and wherein the threaded portion of the screw is sized to fit within and engage the first and second threaded bores.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
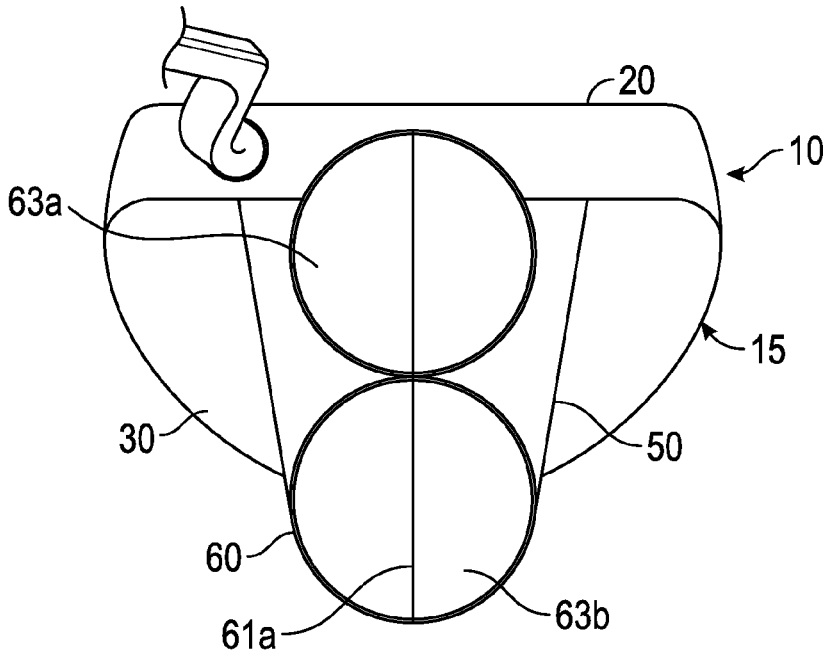
FIG. 1 is a top plan view of a preferred embodiment of the present invention.

A preferred embodiment of the present invention is shown in FIGS. 1-4. In this embodiment, a putter-type club head 10 comprises a body 15 having a front portion 20 with a striking face 25 and a sole 30 extending rearwards from a lower edge 22 of the front portion 20, such that the body 15 has an L-shaped structure. The body 15 also includes a protrusion 40 extending from a central area 35 of the upper surface 32 of the sole 30. The protrusion 40 has a through bore 45 that extends through the sole 30 and ends at an opening in a lower surface (not shown) of the sole 30. The through bore 45 may be threaded, but preferably has a smooth interior surface. The body 15 preferably is composed of a metal material such as steel, tungsten, or titanium, and its L-shaped structure positions the center of gravity at a low, forward position on the head 10.

Figure 2:
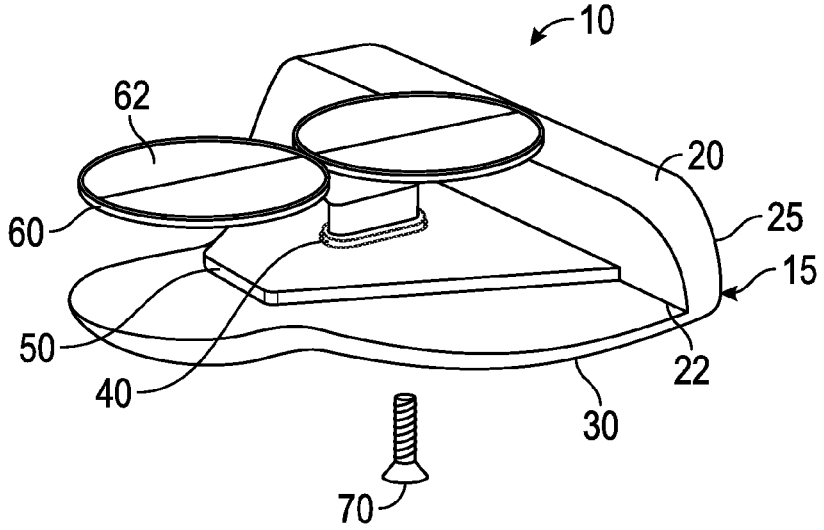
FIG. 2 is a side perspective view of the embodiment shown in FIG. 1, with the divider piece shown in partially transparent form to illustrate the other parts of the embodiment.
Figure 3:
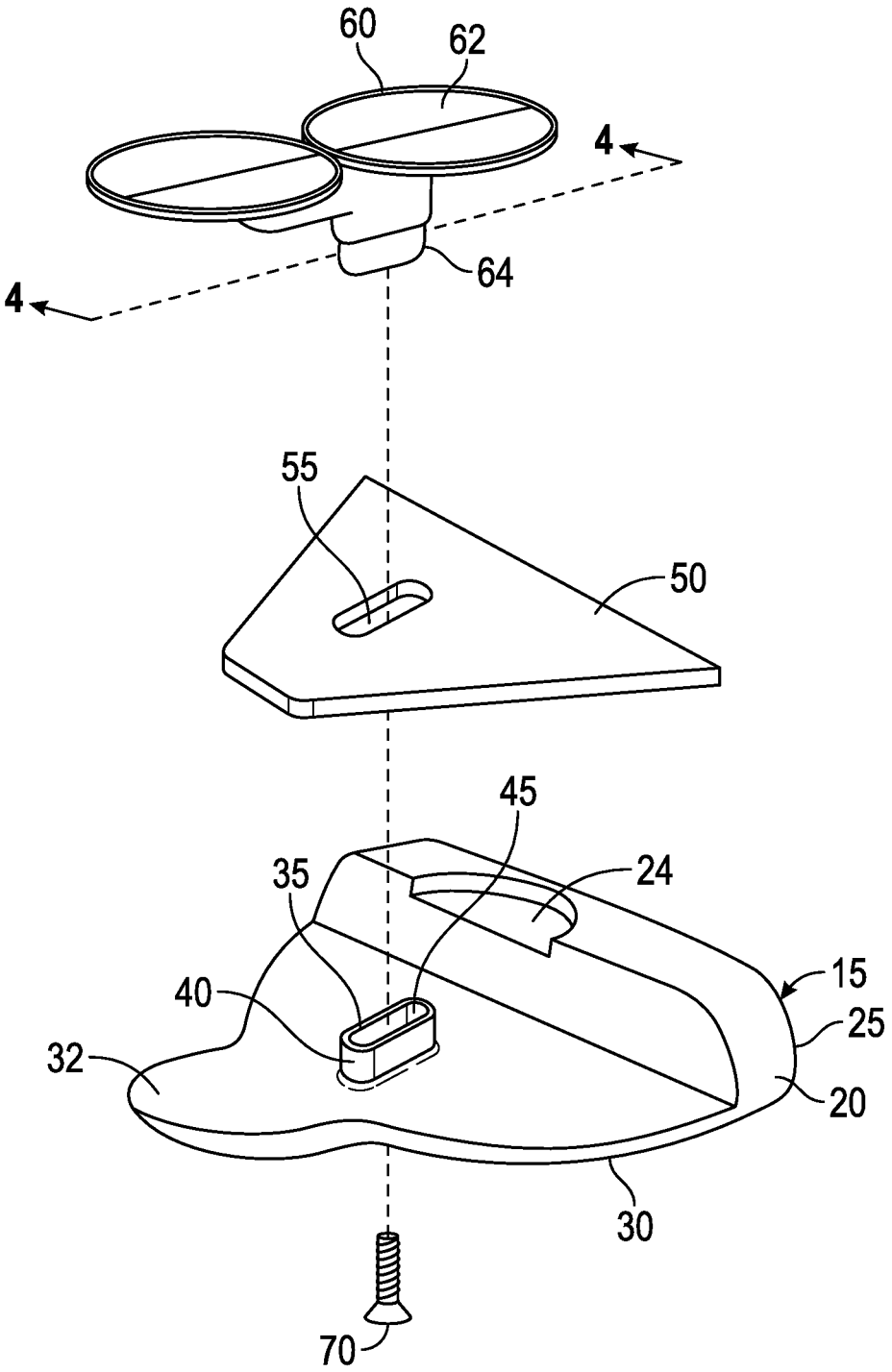
FIG. 3 is an exploded view of the embodiment shown in FIG. 1.
Figure 6:
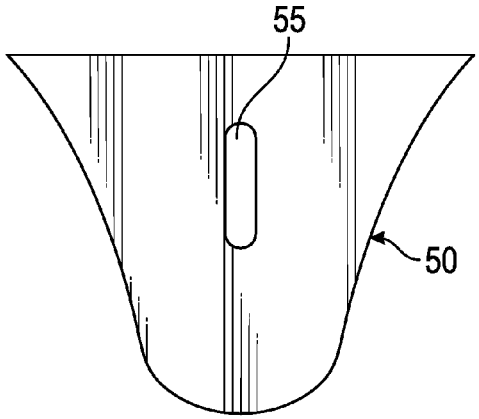
FIG. 6 is a top plan view of an alternative divider piece for engagement with the embodiment shown in FIG. 1.

As shown in FIGS. 1-3, the head 10 includes a divider piece 50, which preferably is composed of a lightweight material such as composite, plastic, or another type of polymer, and which includes an opening 55 sized to receive the protrusion 40, which preferably extends through the opening 55. The divider piece 50 preferably has a color that contrasts with the other parts of the head, as shown in the Figures, and is shaped such that it is visible to a user when the putter head 10 is viewed from the top. The divider piece 50 is removable, and thus can be swapped with divider pieces 50 having different shapes, colors, and/or material compositions to adjust the cosmetics and mass properties of the putter head 10. An alternative divider piece 50 having a slightly different shape, which conforms to the shape of the upper surface 32 of the sole 30, is shown in FIG. 6.

Figure 4:
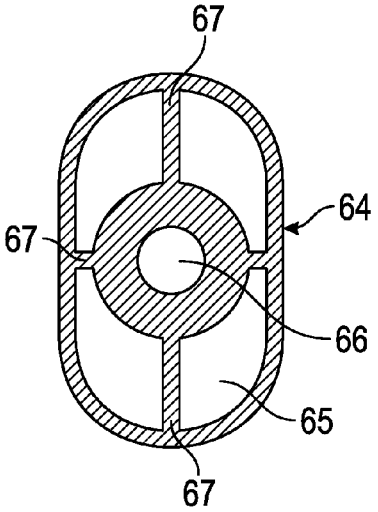
FIG. 4 is a view of the adjustable alignment feature shown in FIG. 3 along lines 4-4.

The head 10 also includes a removable alignment piece 60 comprising a planar alignment feature 62 and a protrusion 64 that extends perpendicular to the alignment feature. At least a part of the protrusion 64 is sized to be received within the through bore 45 of the protrusion 40 extending from the sole 30. The protrusion 64 includes a threaded bore 66 that aligns with the through bore 45 of the protrusion 40, and is sized to receive the threads of a screw 70 that removably fixes the alignment piece 60 and the divider piece 50 to the sole 30 of the body 15. As shown in FIG. 4, the protrusion 64 preferably comprises a skeletal structure, with the threaded bore 66 suspended inside a hollow portion 65 and held in place by a plurality of struts 67. The alignment piece 60 preferably is composed of a non-metal material, such as a polymer or composite, but can be formed of a metal material if a user wishes to raise the center of gravity location or otherwise adjust the mass properties of the putter head 10.

Figure 5:
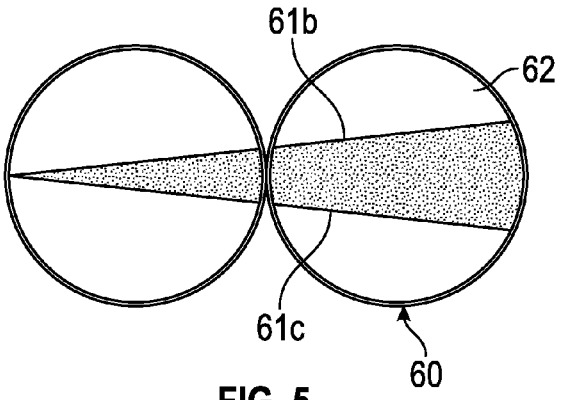
FIG. 5 is a top plan view of an alternative adjustable alignment feature for engagement with the embodiment shown in FIG. 1.

The alignment feature 62 of the preferred embodiment comprises a pair of circles 63*a*, 63*b* having the same approximate size as a golf ball and a straight line 61*a* bisecting the two circles 63*a*, 63*b* and extending perpendicular to the striking face 25. In an alternative embodiment, shown in FIG. 5, the alignment feature 62 may comprise a pair of converging lines 61*b*, 61*c* that extend across the pair of circles 63*a*, 63*b* towards the striking face 25. The alignment feature 62 preferably has a light color, and the divider piece 50 preferably has a contrasting dark color. As discussed herein, the divider piece 50 can be swapped for a different divider piece 50 having a different contrasting color and/or shape to better draw the golfer's eyes to the alignment feature 62.

As shown in FIG. 3, the front portion 20 of the body 15 includes an upper surface 21, which has a recess 24 shaped to receive a portion of one of the circles 63*a*, 63*b* of the alignment feature 62. The recess 24 has a depth that is equivalent to the thickness of the alignment feature 62, such that the upper surface of the alignment feature 62, when engaged with the body 15, is flush with the upper surface 21 of the front portion 20 and provides a continuous sighting plane for a golfer.

In another embodiment, the putter head 10 may be sold as a kit to consumers, with a single body 15 and multiple divider pieces 50, alignment pieces 60, and screws 70 having different shapes, colors, alignment features 62, and/or material compositions to allow a consumer to customize the putter head 10 for optimal performance.

The embodiments disclosed herein may include any of the features of the golf club heads disclosed in U.S. Pat. Nos. 7,244,191 and 8,480,504, the disclosure of each of which is hereby incorporated by reference in its entirety herein.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention:

1. A putter comprising:

a body comprising a face portion having a face upper surface, a sole portion having a sole upper surface and a sole lower surface, a first protrusion extending from the sole upper surface, and a through-bore extending through the first protrusion from the sole lower surface to an upper surface of the first protrusion; and an alignment piece comprising a planar alignment feature and a second protrusion extending perpendicular to the planar alignment feature, wherein the second protrusion comprises a structure having a threaded bore, and wherein the second protrusion is received within the through-bore.

2. The putter of claim 1, wherein the structure is disposed within a hollow portion of the second protrusion, and wherein the structure is supported by a plurality of struts.

3. The putter of claim 1, wherein the planar alignment feature comprises at least two circles.

4. The putter of claim 3, wherein the planar alignment feature comprises a line bisecting each of the two circles.

5. The putter of claim 3, wherein the planar alignment feature comprises a pair of converging lines, each of which extends across the two circles.

6. The putter of claim 3, wherein the face upper surface comprises a recess sized to receive a portion of one of the two circles.

7. The putter of claim 6, wherein the recess has a depth that is equivalent to a thickness of the planar alignment feature.

8. The putter of claim 3, wherein each of the at least two circles has the same approximate size as a golf ball.

9. The putter of claim 1, wherein the first protrusion extends from a central area of the sole upper surface.

10. The putter of claim 1, further comprising a screw comprising a head and a threaded portion, wherein the second protrusion comprises a threaded bore, and wherein the threaded portion extends through the through-bore and engages the threaded bore of the second protrusion to removably fix the alignment piece to the body.

11. The putter of claim 1, wherein the through-bore comprises a smooth interior surface.

12. The putter of claim 1, wherein the sole portion extends rearwards from a lower edge of the face portion, and wherein the body has an L shape.

13. The putter of claim 1, wherein the alignment piece is composed of a first material selected from the group consisting of composite, plastic, and aluminum, and wherein the body is composed of a second material selected from the group consisting of steel, tungsten, and titanium.

14. A putter comprising:

a metal body comprising a face portion having a face upper surface, a sole portion having a sole upper surface and a sole lower surface, a first protrusion extending from the sole upper surface, and a through-bore extending through the first protrusion from an opening in the sole lower surface to an opening at an upper surface of the first protrusion;

a non-metal alignment piece comprising a planar alignment feature and a second protrusion extending perpendicular to the planar alignment feature; and a screw comprising a head and a threaded portion, wherein the planar alignment feature comprises at least one circle having the same approximate size as a golf ball, wherein the face upper surface comprises a recess sized to receive a portion of the at least one circle, wherein the recess has a depth that is equivalent to a thickness of the planar alignment feature, wherein the second protrusion comprises a threaded bore, wherein the second protrusion is received within the through-bore, and wherein the threaded portion extends through the through-bore and engages the threaded bore of the second protrusion to removably fix the alignment piece to the body.

15. The putter of claim 14, wherein the alignment piece is composed of a first material selected from the group consisting of composite, plastic, and aluminum, and wherein the body is composed of a second material selected from the group consisting of steel, tungsten, and titanium.

16. The putter of claim 14, wherein the through-bore comprises a smooth interior surface.

17. The putter of claim 14, wherein the sole portion extends rearwards from a lower edge of the face portion, and wherein the body has an L shape.

18. The putter of claim 14, wherein the first protrusion extends from a central area of the sole upper surface.

* * * * *